United States Patent [19]

Adler

[11] Patent Number: 4,794,839

[45] Date of Patent: Jan. 3, 1989

[54] MUSICAL INSTRUMENT PICK FOR SIMULTANEOUS TWO PERSON USE

[76] Inventor: Roberta S. Adler, 13171 Coleman Pl., Garden Grove, Calif. 92643

[21] Appl. No.: 169,816

[22] Filed: Mar. 18, 1988

[51] Int. Cl.[4] ..... G10D 3/16
[52] U.S. Cl. ..... 84/322
[58] Field of Search ..... 84/322

[56] References Cited

U.S. PATENT DOCUMENTS

| | | | |
|---|---|---|---|
| 1,784,934 | 12/1930 | Johansson | 84/322 |
| 3,789,720 | 2/1974 | McIntyre | 84/322 |
| 3,992,975 | 11/1976 | Gallagher | 84/322 |
| 4,320,689 | 3/1982 | Pogoda | 84/322 |

FOREIGN PATENT DOCUMENTS

| | | | |
|---|---|---|---|
| 314513 | 9/1919 | Fed. Rep. of Germany | 84/322 |

*Primary Examiner*—Lawrence R. Franklin
*Attorney, Agent, or Firm*—Roy A. Ekstrand

[57] ABSTRACT

A musical instrument pick comprises a pair of generally cylindrical handles maintained in a spaced parallel relationship by a pair of generally cylindrical supports. One of the cylindrical handles is fabricated from two semicylindrical portions which are secured together by a pair of circular clamps. A flexible musical pick is captivated between the semicylindrical half portions and extends downwardly from the handle. The instrument pick is intended for therapeutic and instructional use and is capable of being simultaneously grasped by two persons.

12 Claims, 2 Drawing Sheets

FIG. 3
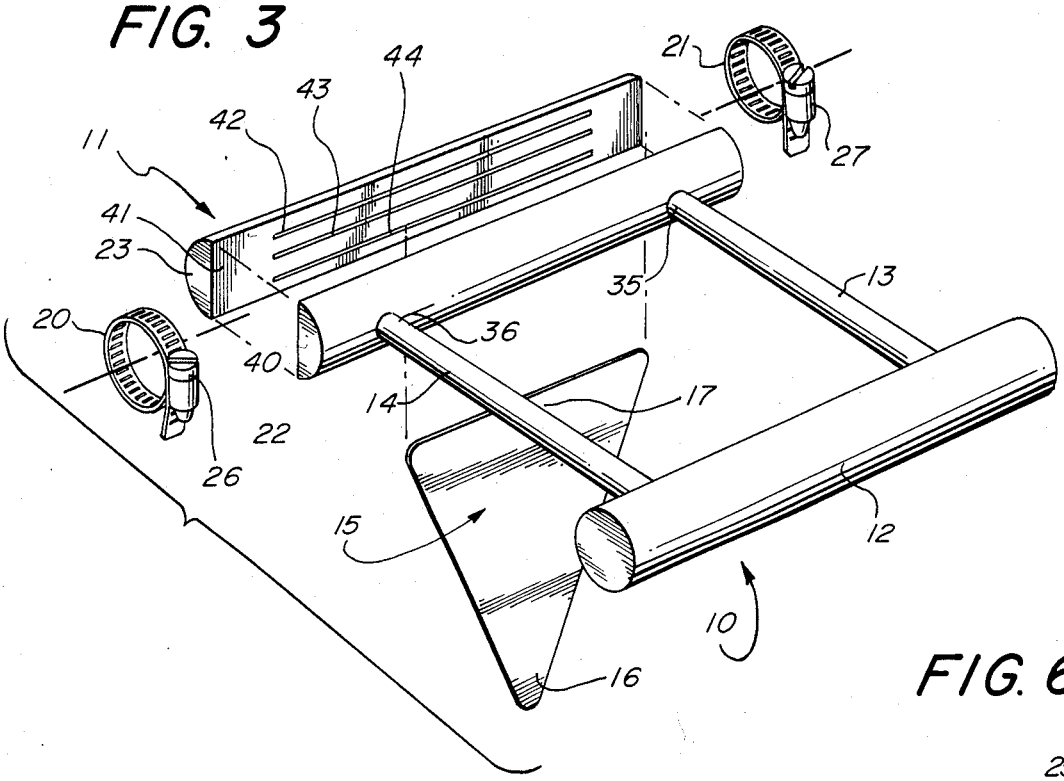
FIG. 6
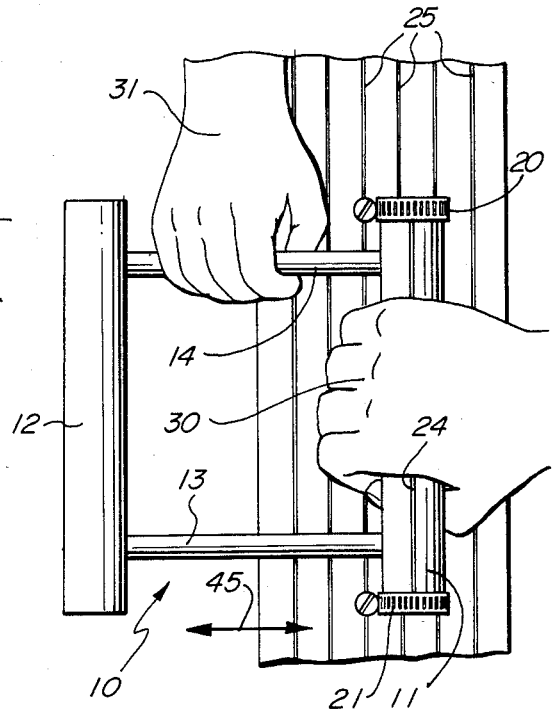
FIG. 4
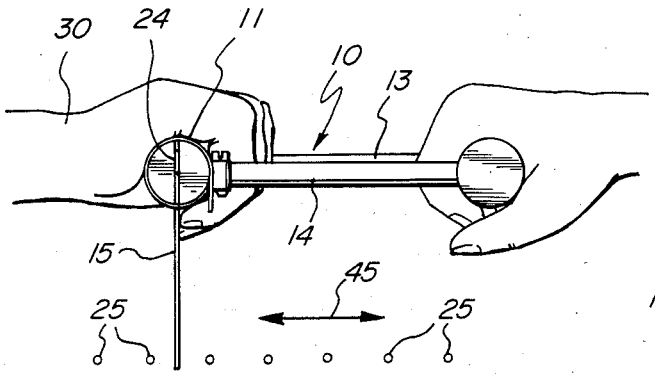
FIG. 5
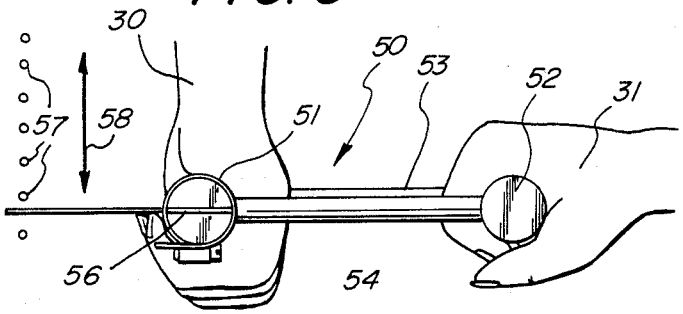
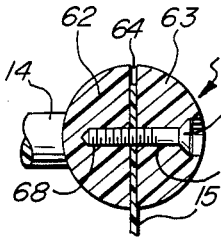
FIG. 7

MUSICAL INSTRUMENT PICK FOR SIMULTANEOUS TWO PERSON USE

FIELD OF THE INVENTION

This invention relates generally to therapeutic and educational devices and particularly to those used with stringed musical instruments.

BACKGROUND OF THE INVENTION

Through the years therapists working with the aged, emotionally and/or developmentally disabled and physically impaired have realized that substantial therapeutic value is found in the use of musical instruments in their various therapies. It has, for example, been found extremely helpful to utilize therapy in which the strumming of a stringed instrument such as a guitar or autoharp is employed. While the benefits of such music related therapy are substantial, several problems arise in utilizing such instruments in therapy related to the aged, emotionally and/or developmentally disabled or physically impaired. For example, such persons frequently have difficulty grasping or holding the pick which is utilized to pluck or strum the strings of instruments such as guitars or autoharps. The aged, for example, are often encumbered by substantial arthritic conditions in their fingers and hands. As a result, the grasping or holding of a pick may be a task of great difficulty and sometimes painful. Similarly, emotionally and/or developmentally disabled persons often lack the small motor coordination required to grasp and manipulate or orient a pick for use with stringed instrument. In addition to difficulties grasping or holding the pick, the aged, emotionally and/or developmentally disabled or physically impaired often encounter difficulties in establishing the consistent rhythmic strumming motions over the stringed instruments necessary to establish a beneficial and encouraging musical sound.

To reduce the effect of these difficulties, the therapist often attempts to aid the patient by taking hold of the patient's hand to aid in grasping the pick and rhythmically strumming. In many instances, however, the patient's hand may be extremely fragile or otherwise impaired in a manner whereby the therapist's grasp actually produces discomfort or pain on the part of the patient. Similarly, some patients through emotional preference, may prefer not to have their hand or arm grasped by the therapist at a particular point in the therapist-patient relationship. Thus, a need arises for a means by which the grasping of a musical instrument pick by an impaired patient may be made easier and by which a therapist may assist the patient in a strumming motion without grasping the patient.

A similar need often arises in music education activities which are directed to extremely young children. While the benefits of early introduction to musical activities such as those employing a stringed instrument are of great benefit in the child's development, problems often arise in the young child's ability to properly hold a musical instrument pick. In addition, young children may have difficulty learning to establish the rhythmic strumming motion necessary for proper instrument playing. It has often been found in music education of younger children that the initial tasks of learning to play an instrument must be carefully structured to avoid frustration or hostility on the part of the young child. Toward this end, there arises a need for a means to be utilized by music teachers for the teaching of stringed instrument play thereby the pick may be grasped more easily and be more easily controlled and whereby the instructor may assist the student in establishing a proper strumming motion without grasping the student.

Various devices have been developed to assist the aged, emotionally and/or developmentally and physically impaired as well as young children in grasping the musical instrument pick. For example, there has been developed a pick retaining device which generally comprises an elongated wrist cuff adapted to be tightly received upon the wrist and a portion of the forearm of the user. An extending member secured to the wrist cuff and extending into the finger and palm region of the user supports a downwardly extending musical pick which virtually eliminates the need of the user to grasp the musical pick. Such devices permit the user to strum the strings of a musical instrument despite having a handicap or disability in grasping the musical pick. However, they render very little aid to the therapist or instructor in assisting the patient or student in establishing a strumming motion. Another simple device created to aid the patient or student in grasping a musical instrument pick comprises, what is in essence, a substantially enlarged musical pick which by virtue of its greater size is somewhat easier for patients and students with small motor control difficulties to grasp.

While these devices provide some benefit and assistance to patients receiving musical therapy and younger children learning to play stringed instruments, there remains a need in the art for a means whereby patients under therapy and young children learning musical instruments may be assisted in holding the musical instrument pick and whereby therapists and musical educators working with patients and young students may more readily assist and guide the patient and student in establishing a proper strumming motion for stringed instrument play without grasping the patient or student.

SUMMARY OF THE INVENTION

Accordingly, it is a general object of the present invention to provide an improved musical instrument pick. It is a more particular object of the present invention to provide an improved musical instrument pick which may be more easily grasped by persons having poor small motor control or physical impairment. It is a still more particular object of the present invention to provide an improved musical instrument pick which may be simultaneously grasped and guided by two persons.

In accordance with the present invention, there is provided a musical instrument pick for simultaneous two person use having a pair of transverse members and means supporting them in a spaced parallel relationship in which one of the transverse members is adapted to receive and secure a musical instrument pick in a predetermined angular relationship with the supporting transverse member. The transverse members as well as their supports are adapted to be readily grasped by the hand of a user.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 3 is a assembly view of the musical instrument pick shown in FIG. 2;

FIG. 4 is a simplified view of the musical instrument pick of FIG. 2 showing its manner of use;

FIG. 5 is a side elevation view of an alternate embodiment of the present invention musical instrument pick illustrating its use;

FIG. 6 is a top view of a musical instrument pick constructed in accordance with the present invention showing an alternate hand attachment; and FIG. 7 is a partial section view of an alternate embodiment of the present invention musical instrument pick.

DESCRIPTION OF THE PREFERRED EMBODIMENTS

Figure 1:
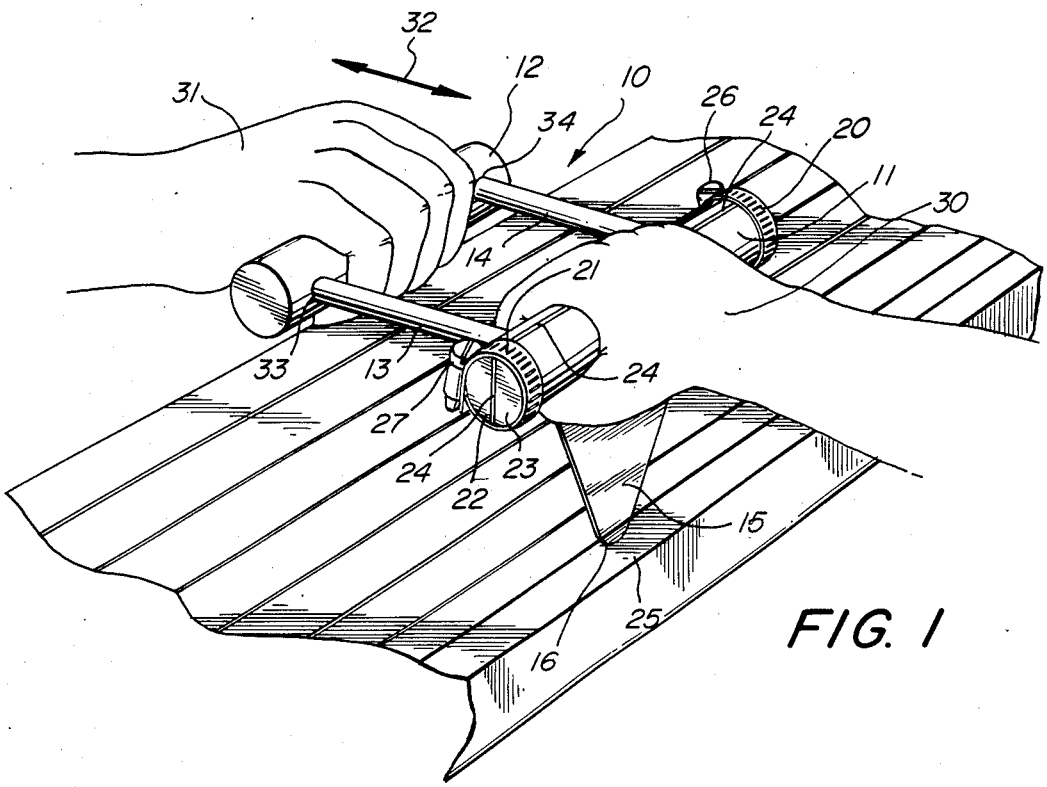
FIG. 1 is a perspective view of the present invention musical instrument pick grasped in a typical fashion by a pair of user's hands.

FIG. 1 sets forth a perspective view of the present invention musical instrument pick generally referenced by numeral 10 in perspective view. A pair of generally cylindrical handles 11 and 12 are supported in a spaced generally parallel relationship by a pair of cylindrical support members 13 and 14. Handle 11 comprises a semicylindrical handle portion 22 and a semicylindrical handle portion 23 joined to form a seam 24 extending the length of handle 11 as more clearly set forth below in FIG. 3. A generally planar triangular pick or plectrum 15, which in its preferred form is formed of a flexible plastic material or the like, extends downwardly from and is received within seam 24 between handle portions 22 and 23. The structure of pick 15 is set forth below in FIG. 3 in greater detail. However, suffice it to note here that pick 15 includes a generally pointed end 16 extending downwardly from handle 11 and a base portion 17 (seen in FIG. 3) which extends within and is captivated within seam 24. A pair of circular clamps 20 and 21 are secured to each end of cylindrical handle 11 and include conventional fasteners 26 and 27. While any number of clamps structures may be utilized for clamps 20 and 21, it has been found advantageous to employ circular clamps of the variety frequently used in flexible hose connections which in accordance with conventional clamp fabrication techniques are configured to be tightened in a constricting manner by the appropriate turning of fasteners 26 and 27. It will be apparent to those skilled in the art, however, that any number of constricting type clamps may be substituted for clamps 20 and 21 without departing from the spirit and scope of the present invention.

In the position shown in FIG. 1 a pair of hands 30 and 31 are shown holding handles 11 and 12 respectively. A plurality of musical instrument stings 25, which may for example be the strings of an Autoharp or the like, extend horizontally beneath musical instrument pick 10 as it is supported by hands 30 and 31. It should be further noted that as hands 30 and 31 support musical instrument pick 10 above strings pointed end 16 extends downwardly between and below strings 25. handle 11 as shown such that pick 15 FIG. 1 extends downwardly among strings 25. In addition, hand 31 grasps handle 12 so as to maintain the proper orientation of pick 15 with respect to strings 25. In the normal use of musical instrument pick 10, hand 30 may for example represent the hand of the therapy patient or musical student while hand 31 represents the hand of the therapist or music instructor. Accordingly due to the rigid structure formed by the combination of handles 11 and 12 and support members 13 and 14, hand 31 may impart guiding and controlling forces to musical pick 10 to aid hand 30 in moving pick 15 across strings 25 to strum the musical instrument. As can be seen, the structure of musical instrument pick 10 permits twisting forces applied to handle 12 coupled through supports 13 and 14 to handle 11 to control the orientation of handle 11 and assist the patient or student's hand 30. In addition, hand 31 may impart lateral forces in the direction of arrow 32 to handle 12 which are similarly coupled by supports 13 and 14 to handle 11 so as to move pick 15 in the lateral or strumming direction indicated by arrow 32. It should be noted that, in accordance with an important aspect of the present invention, hand 31 need not grasp hand 30 to facilitate the proper orientation of musical instrument pick 10 or provide the proper strumming action of the musical instrument pick. It should also be noted that the structure of handle 11 and pick 18 facilitates the grasp of hand 30 in an easier fashion and with less difficulty than encountered in the grasp of a conventional musical instrument pick. It should be further noted as will be set forth in greater detail, that the use of musical instrument pick 10 is not restricted to the hand arrangement shown in FIG. 1. For example, while in its preferred form, hand 30 would be the hand of the therapy patient or musical student and hand 31 the hand of the therapist or instructor, the position of musical instrument pick 10 may be reversed such that hand 30 grasps handle 12 and hand 31 grasps handle 11 in essence reversing the arrangement in FIG. 1. By way of further alternative and as is set forth below in FIG. 6, a still further alternative arrangement may be utilized in which either of hands 30 or 31 grasp either of supports 13 or 14. In essence, therefore, handles 11 and 12 and supports 18 and 14 permit musical instrument pick 10 to be grasped in a number of combinations suited to the therapy or musical education requirements and the particular needs of the therapy patient or student.

Figure 2:
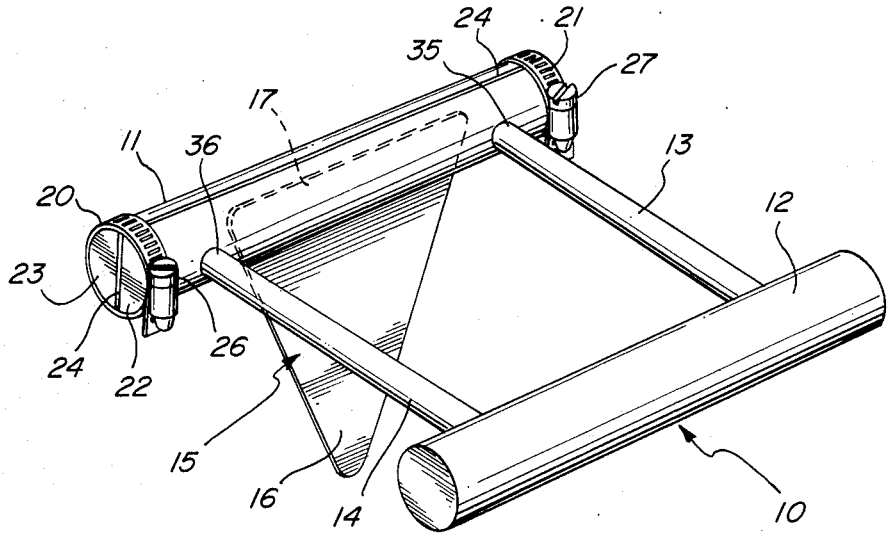
FIG. 2 is a perspective view of a musical instrument pick constructed in accordance with the present invention.

FIG. 2 sets forth a perspective view of musical instrument pick 10 without hands 30 and 31 rotated from the position shown in FIG. 1. As set forth above, musical instrument pick 10 includes a pair of generally cylindrical handles 11 and 12. A pair of generally cylindrical support members 13 and 14 extend between handles 11 and 12 and are secured to handle 11 by joints 35 and 36 respectively and to handle 12 by joints 33 and 34 respectively (seen in FIG. 1). As is also set forth above, cylindrical handle 11 is formed of a pair of semicylindrical handle portions 22 and 23 Which meet to form a seam 24 extending the length of handle 11. Pick 15 comprises a generally triangular member having a pointed end 16 extending downwardly and a lateral base portion 17 which is received Within seam 24 between handle portions 22 and 2 and maintained therein by the closure of clamps 20 and 21. It should be noted that, in accordance with an important aspect of the present invention, the captivation of base portion 17 of pick 15 between handle portions 22 and 23 by clamps 20 and 21 securely maintains the position of pick 15 while permitting the replacement thereof in the event of damage or other cause for replacement of pick 15 arises. Pick 15 is removed and replaced by first loosening clamps 20 and 2 through the rotation of fasteners 26 and 27 until seam 24 parts and pick 15 may be withdrawn. Thereafter, a replacement pick may be inserted into seam 24 in the manner shown for pick 15 and fasteners 26 and 27 rotated to tighten clamps 20 and 21 respectively and once again securely captivate the replacement pick within handle 11.

In its preferred form, handles 11 and 12 and support members 13 and 14 are formed of food material and are joined by conventional wood glue joints. Accordingly, joints 35 and 36 as well as joints 33 and 34 may, in the preferred form, comprise dowel joints of the type in which supports 11 and 14 extend into suitable recesses formed in handles 11 and 12 and are maintained therein by a suitable adhesive or glue. It will be apparent, however, to those skilled in the art that any number of materials may be used to form musical instrument pick 10 without departing from the spirit and scope of the present invention. For example, handles 11 and 12 and supports 13 and 14 may be formed of a single molded plastic element or the like in which pick 15 is maintained as a separate part to permit replacement of a broken pick. By way of further example, however, it will apparent to those skilled in the art that the entire structure of musical instrument pick 10, including pick 15, may be formed of a single molded plastic unit without departing from the spirit and scope of the present invention.

FIG. 3 sets forth an assembly view of musical instrument pick 10 in which handle 12 is secured to supports 13 and 14 at joints 33 and 34 respectively (seen in FIG. 1). Handle portions 22 and 23 are shown separated with handle portion 22 attached to supports 13 and 14 by joints 35 and 36 respectively. Handle portion 22 defines a generally planar surface 40 while handle portion 28 defines a generally planar surface 40 while handle portion 23 defines a generally planar surface 41. In addition, surface 41 of handle portion 28 defines a plurality of protrusions 42, 43 and 44 extending from surface 41. In the preferred form, surface 40 defines a similar plurality of protrusions (not seen in FIG. 3) which are offset from protrusions 42 through 44 and thus are interleaved therewith in the final assembly. Clamps 20 and 21 are shown removed from handle 11 and expanded sufficiently by the actions of fasteners 26 and 27 respectively to permit clamps 20 and 21 to be received upon handle 11 when handle portions 22 and 23 are brought together at surfaces 40 and 41. Pick 15 includes a pointed end 16 and a base portion 17.

The assembly of the present invention musical instrument pick is carried forward by placing base portion 17 of pick 15 between surfaces 40 and 41 of handles portions 22 and 23 respectively. Thereafter, handle portion 23 is placed against handle portion 22 such that base portion 17 is captivated against protrusions 42 through 44. Thereafter, clamps 20 and 21 are placed upon the end portions of handle 11 and drawn tightly by the action of fasteners 26 and 27 respectively. The drawing forces applied to handle portions 22 and 23 captivate base portion 17 of pick 16 between surfaces 40 and 41.

FIG. 4 sets forth a side elevation view of musical instrument pick 10 supported between hands 30 and 31 above musical instrument strings 25. As can be seen in FIG. 4, pick 15 captivated within seam 24 of handle 11 extends downwardly in a generally perpendicular arrangement to supports 13 and 14. In accordance With the above-described operation, hands 30 and 31 cooperate to move musical instrument pick 10 in the back and forth lateral direction indicated by arrow 45 such that pick 15 strums instrument strings 25.

FIG. 5 sets forth an alternate embodiment of the present invention in which a musical instrument pick 50 includes a cylindrical handle 52 and a cylindrical handle 51. Handle 52 is grasped by hand 31 while handle 51 is grasped by handle 30. A support 54 identical to support 14 of musical instrument pick 10 extends between handles 51 and 52. A seam 56 extends through handle 51 and a pick 55 is received within seam 56 and extends outwardly therefrom. It should be noted that musical instrument pick 50 is identical in structure and fabrication to musical instrument pick 10 with the exception of the orientation of seam 56 within handle 51 It should be noted that, while seam 24 of musical instrument pick 10 is oriented perpendicularly with respect to supports 13 and 14, seam 56 is oriented substantially parallel to supports 3 and 54. As a result, pick 55 extends outwardly from handle 51 in a direction generally perpendicular to that of pick 15 in musical instrument pick 10. A plurality of musical instrument strings 57 are oriented in a vertical plane such as would be experienced in a musical instrument such as a guitar held in the conventional guitar playing fashion. Thus, musical instrument pick 50 may be held in the manner shown by hands 30 and 31 and moved in the strumming direction indicated by arrow 58 to move pick 55 across strings 57 in a vertical guitar strumming motion. It should be apparent from comparison of FIGS. 4 and 5 that the same assistance and guidance may be employed in the use of the alternate embodiment of FIG. 5 as previously described for the embodiment of FIGS. 1 through 4.

FIGS. 6 sets forth a top view of musical instrument pick 10 situated above strings 25 in the manner shown in FIG. 1. By way of alternative example, however, hand 30 corresponding in most instances to the hand of the patient or music student grasps handle 11 while hand 31 corresponding to the therapist or musical instructor grasps support 14. In the manner of use shown in FIG. 6. musical instrument pick 10 is moved laterally across strings 25 in the manner described above and as shown by arrow 45. Thus, FIG. 6 sets forth an alternate configuration in which musical instrument pick 10 may be held by the users.

FIG. 7 sets forth a section view of an alternate embodiment for the attachment of the handle portions to captivate pick 15. Accordingly, a pair of handle portions 62 and 63 form a handle 61. Handle 61 and handle portions 62 and 63 are identical to handle 11 and handle portions 22 and 23 respectively with the exception of the provision of a aperture 66 through handle portion 63 and an aperture 68 in handle portion 62. A conventional fastener 67 extends through aperture 66 in handle portion 63 and is threadably received within aperture 68 in handle portion 62. Handle portions 61 and 62 are thus drawn together captivating pick 15 within a seam 64 in the same manner provided by clamps 20 and 21 in the above-described embodiment. It will be understood that a similar fastening arrangement is provided at the other end of handle 61 in the embodiment of FIG. 7 in the same locations as clamps 20 and 21 occupy in the above-described embodiment shown in FIG. 1.

What has been shown is an improved musical instrument pick which may be more easily grasped by persons having poor small motor control or physical impairment and which may be simultaneously used by two persons to facilitate musical therapy or musical instruction.

While particular embodiments of the invention have been shown and described, it will be obvious to those skilled in the art that changes and modifications may be made without departing form the invention in its broader aspects. Therefore the aim in the appended claims is to cove all such changes and modifications as fall within the true spirit and scope of the invention.

What which is claimed is:

1. For use in strumming a stringed instrument, a musical instrument pick comprising:

a pair of handles;

a pair of supports, joined to said handles and maintaining them in a generally spaced parallel relationship;

a generally planar pick having a strumming end; and means for securing said generally planar pick to one of said handles.

2. A musical instrument pick as set forth in claim 1 wherein said pair of handles and said pair of supports form a closed planar configuration.

3. A musical instrument pick as set forth in claim 2 wherein said pair of handles and said pair of supports form a rectangular configuration in which said handles and said supports occupy alternate sides.

4. A musical instrument pick comprising a closed member having a center aperture therein, said closed member defining a shape and size capable of being simultaneously grasped by two hands and having a generally planar plectrum attached to said closed member and extending therefrom.

5. A musical instrument pick as set forth in claim 4 wherein said closed member and said center aperture are rectangular and wherein said pick plectrum generally perpendicular thereto.

6. A musical instrument pick as set forth in claim 4 wherein said closed member and said center aperture are rectangular and wherein said pick plectrum extends generally parallel thereto.

7. A musical instrument pick comprising:

first and second elongated handles;

first and second elongated supports joined to said first and second handles to form a generally rectangular configuration;

a generally planar pick member having a strumming portion and a base portion; and attachment means securing said pick member to said first handle.

8. A musical instrument pick as set forth in claim 7 wherein said firs handle defines a pair of handle portions and wherein said base portion of said pick member is captivated between said pair of handle portions.

9. A musical instrument pick as set forth in claim 8 therein said first and second supports and said second handle are generally cylindrical and wherein said pair of handle portions are generally semicylindrical.

10. A musical instrument pick as set forth in claim 9 wherein said attachment means include a pair of circular clamps encircling said pairs of handle portions.

11. A musical instrument pick as set forth in claim 10 wherein said first and second handles and said first and second supports define a common plane and wherein said pick member extends generally perpendicular to said common plane.

12. A musical instrument pick as set forth in claim 10 wherein said first and second handles and said first and second supports define a common plane and wherein said pick member extends generally outwardly and parallel to said common plane.

* * * * *